United States Patent [19]

Chezzi

[11] Patent Number: 4,939,919

[45] Date of Patent: Jul. 10, 1990

[54] ROLL FORMING MACHINE

[75] Inventor: Aleardo Chezzi, Boretto, Italy

[73] Assignee: OTO MILLS S.p.A., Boretto, Italy

[21] Appl. No.: 277,660

[22] Filed: Nov. 29, 1988

[30] Foreign Application Priority Data

Sep. 23, 1988 [IT] Italy ..... 40140 A/88

[51] Int. Cl.[5] ..... B21B 35/14

[52] U.S. Cl. ..... 72/181; 72/249

[58] Field of Search ..... 72/181, 182, 180, 179, 72/176, 226, 238, 239, 249

[56] References Cited

U.S. PATENT DOCUMENTS

| | | | |
|---|---|---|---|
| 287,008 | 10/1883 | Daniels | 72/238 |
| 1,833,376 | 11/1931 | Simmons | 72/226 |
| 1,950,573 | 3/1934 | Schreck | 72/249 |
| 2,722,392 | 11/1955 | Talbot | 248/678 |
| 3,320,789 | 5/1967 | Marx | 72/249 |
| 3,334,505 | 8/1967 | Boiko et al. | 72/239 |
| 3,355,923 | 12/1967 | Gillet | 72/238 |

FOREIGN PATENT DOCUMENTS

| | | | |
|---|---|---|---|
| 10344 | 1/1980 | Japan | 72/238 |
| 9533 | 1/1982 | Japan | 72/179 |

*Primary Examiner*—Daniel C. Crane

*Attorney, Agent, or Firm*—Balogh, Osann, Kramer, Dvorak, Genova & Traub

[57] ABSTRACT

The roll forming machine consists in a succession of stands (1), each carrying at least two parallel forming rolls (12, 13) carried by shafts (48, 49) journaled on either side to a pair of uprights (16, 17) anchored permanently to a base (2) that can be clamped to and separated from the fixed bed (3) of the machine; the rolls (12, 13) of each stand are driven by way of respective p.t.o. shafts (32, 33) mounted to a further fixed upright (27) and carried in journal blocks (34, 35) of which at least one associates with the upright on a floating fit that will allow a margin of transverse movement in relation to the axis of rotation. Self-aligning couplings (38, 39) are used to connect the roll shafts (48, 49) with the p.t.o. shafts (32, 33).

4 Claims, 3 Drawing Sheets

ROLL FORMING MACHINE

BACKGROUND OF THE INVENTION

The invention relates to a roll forming machine for the manufacture of metal section components, and of tube in particular.

The prior art is typified by roll forming machines that comprise a plurality of stands arranged in succession, each one of which houses at least two forming rolls disposed with axes parallel and mounted to respective shafts freely journaled at each end to supports carried by massive uprights. The work is passed through a series of mating rolls the size and shape of which will be determined by the size and shape of the section to be produced. Thus, changeover to a new production run almost invariably dictates part or total replacement of the rolls in the various stands.

Clearly enough, changeover must be effected with the rolls at standstill, and where conventional machinery is concerned this signifies a lengthy operation during which the entire production line necessarily remains idle.

When fitting the replacement rolls, considerable time is consumed in truing up the drivelines to ensure an accurate alignment, hence a faultless coupling action, between the power take-off shafts and the roll shafts.

The object of the invention is to embody a roll forming machine in which the rolls can be replaced with the maximum of despatch, entirely or in part, every time that the changeover to a new production run so dictates.

SUMMARY OF THE INVENTION

The stated object is achieved, with others, in the roll forming machine according to the invention, Such a machine consists in a plurality of stands arranged in succession, each supporting at least two forming rolls disposed with axes parallel and mounted to shafts freely journaled at each end to blocks carried by massive uprights and caused to rotate about their respective axes in opposite directions.

The essential features of the machine disclosed is that it comprises at least one base, capable of being locked to and removed from the bed of the machine, to which the uprights of at least one roll stand are permanently anchored, and at least one fixed upright, located a short distance to one side of the uprights of the stand, that carries two p.t.o. shafts aligned axially with the roll shafts and freely supported in rotation by two relative journal blocks at least one of which is mounted to the upright in such a manner as to be allowed a marginal degree of shift transverse to the relative axis of rotation.

The drive system comprises a geared motor, driving the p.t.o. shafts, and two couplings by which the p.t.o. shafts and roll shafts are caused to rotate as one, each of which consists in two connectable halves, turning as one with the p.t.o. shaft and with the roll shaft respectively, the embodiment of which is such that assembly of the coupling automatically ensures mutual alignment of the axes of the interconnected shafts.

BRIEF DESCRIPTION OF THE DRAWINGS

The invention will now be described in detail, by way of example, with the aid of the accompanying drawings, in which.

DESCRIPTION OF THE PREFERRED EMBODIMENTS

Figure 1:
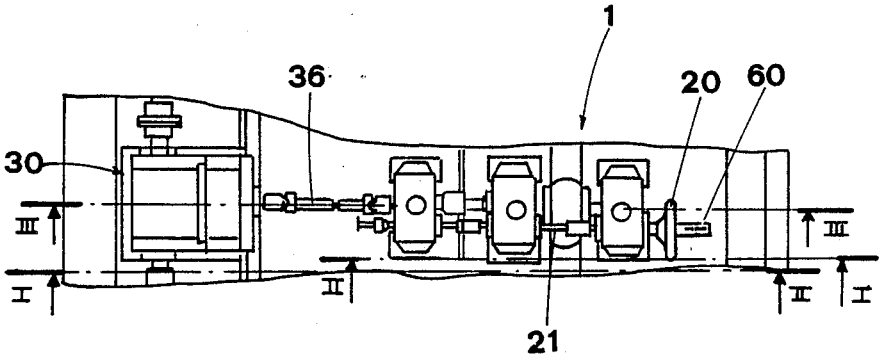
FIG. 1 is a schematic representation of the machine viewed in plan from above.

With reference to the drawings, 1 denotes one of a plurality of stands supporting the train of rolls in a forming machine for the continuous manufacture of metal section, and in particular, metal tube. Each stand 1 carries two forming rolls 12 and 13, disposed with their axes parallel and mounted fast to two center shafts 48 and 49 in such a way that each roll turns as one with the relative shaft.

The roll shafts 48 and 49 are both power driven, freely supported at each end by respective pairs of journal blocks 14 and 15, and rotate about their respective axes in opposite directions. 16 and 17 denote two massive uprights on either side of the rolls, to which the journal blocks 14 and 15 are mounted.

The clearance between the two rolls 12 and 13 is adjusted by operating a pair of lead screw type mechanisms 18 and 19, worked by a handwheel 20, to raise or lower the upper journal blocks 14 on the uprights 16 and 17. More exactly, the movement of the handwheel 20 is transmitted direct through one screw mechanism 19 to the block 14 of the relative upright 17, and relayed by way of a shaft 21 to the mechanism 18 of the remaining upright 16.

In a preferred embodiment, the handwheel 20 will be fitted with a spindle 60 by which the screws 18 and 19 can be coupled to a mechanical actuator, thereby enabling power-assisted movement of the blocks 14. The two uprights 16 and 17 are anchored permanently to a base denoted 2, which can be clamped to and removed from the machine bed 3.

The base 2 rests on a horizontal table 4, across which it can be traversed through a short distance, guided in a direction parallel with the axes of the two rolls 12 and 13, and locked stably in position against a fixed stop 5.

Figure 2:
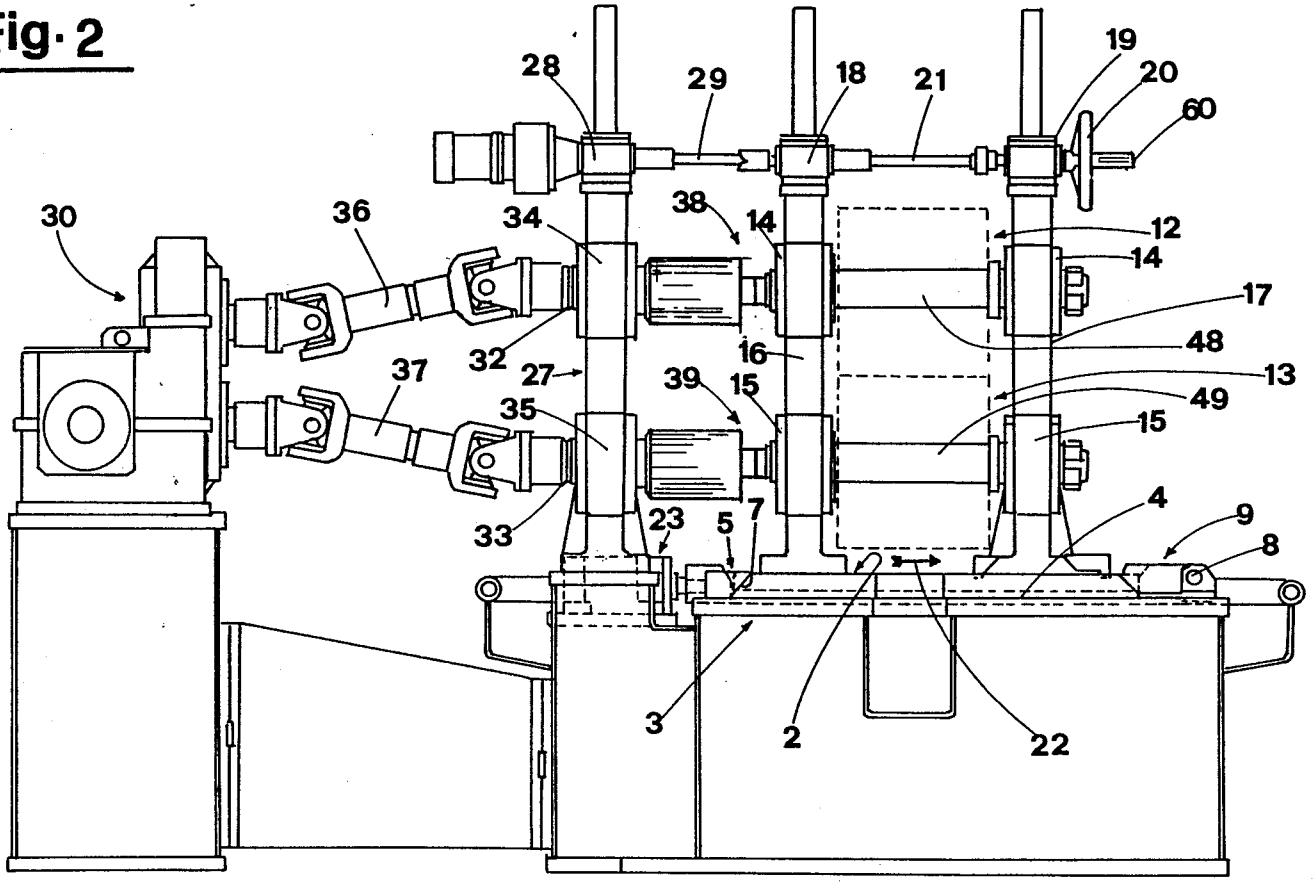
FIG. 2 is the section through I—I in FIG. 1, seen in enlarged scale.
Figure 3:
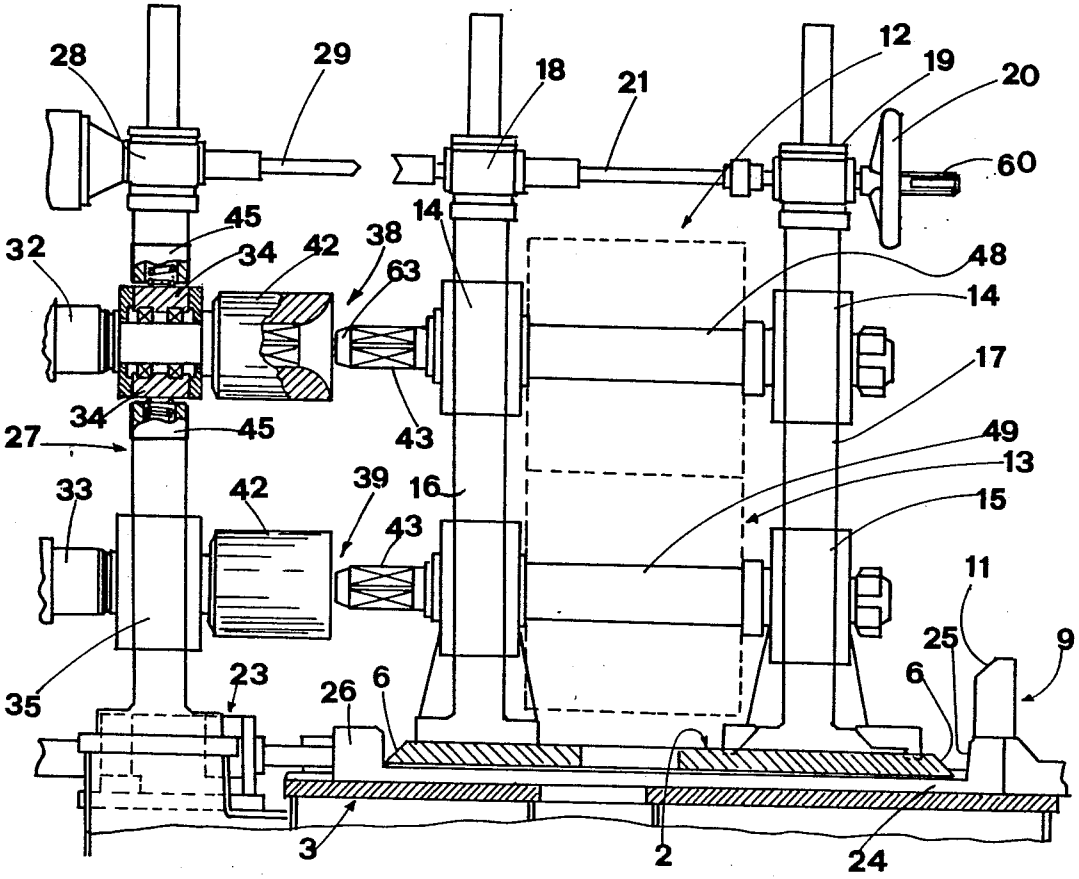
FIG. 3 is the section through II—II in FIG. 1, seen in enlarged scale.

The stability of the base is assured not only in the horizontal direction parallel with the axes of the rolls, but in the vertical direction also, as its clamped surfaces 6 are inclined in relation to the vertical; as can be observed from FIGS. 2 and 3, one such surface 6 engages with a surface 7 of the fixed stop 5 that is inclined complementarily to create an acute angle with the table 4, and another surface 6 engages with the complementarily angled surface 11 of a movable stop 9 positioned at the opposite side of the table from the fixed stop 5; in the example illustrated, the movable stop 9 is hinged about a pivot denoted 8.

The base 2 is traversed in the direction arrowed 22 parallel with the axes of the rolls 12 and 13 by a device operating in conjunction with the table 4; Such a device comprises a double-acting ram 23 by which axial movement is transmitted to a beam 24 incorporating two vertical projections 25 and 26, spaced apart at a given distance that allows them to encompass and impinge correspondingly upon the opposite sides of the base 2; more precisely, the projection denoted 25 operates at the side of the table farthest from the fixed stop 5 so as to clamp the base in position against the relative angled surface 7, and the projection denoted 26 operates at the side nearest the fixed stop 5 in order to produce the release movement that distances the base from the angled surface 7.

All that is required to effect the traverse is to raise the movable stop 9, rotating it clockwise as viewed in FIG. 2, then to distance the opposite side of the base 2 far enough from the fixed stop 5 to enable separation of the stand 1 from the bed 3. 27 denotes a fixed upright, positioned alongside the upright denoted 16, supporting two horizontal power take-off shafts 32 and 33 that are disposed with their axes parallel and journaled to relative blocks 34 and 35 in such a way as to enable axial alignment with the two roll shafts 48 and 49.

The uppermost journal block 34 is supported by way of spring means, denoted 46 in their entirety, and carried in an intermediate mounting 45 that can be secured at a given height on the fixed upright 27. The height adjustment in question is effected with a further lead screw mechanism 28, identical in all respects to the two mechanisms 18 and 19 already mentioned and connected thereto by way of a shaft denoted 29.

Figure 4:
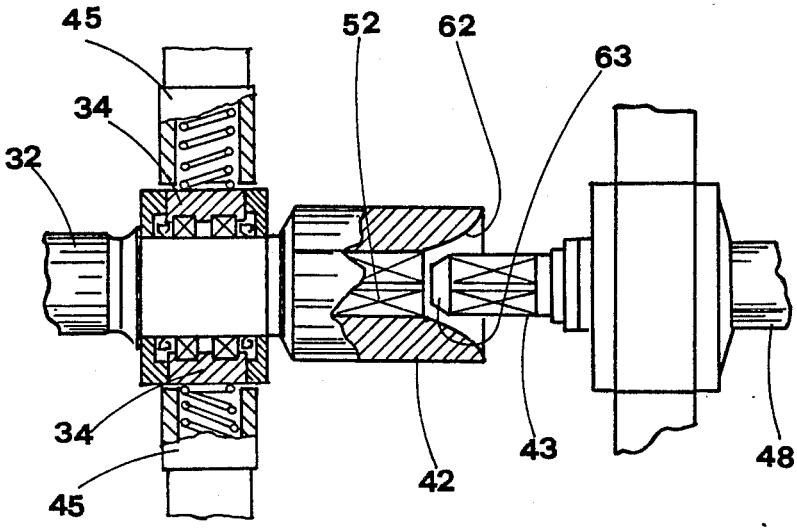
FIG. 4 shows a detail of FIG. 3, viewed partly in section taken through III—III in FIG. 1 and seen in enlarged scale.

Supported flexibly by the intermediate mounting 45 in this manner, the block 34, and accordingly, the shaft 32 it accommodates, are allowed a marginal degree of shift in the vertical direction (FIG. 4). The p.t.o. shafts 32 and 33 are rotated by a geared motor 30, from which drive is transmitted by way of shafts denoted 36 and 37, and associate with the corresponding forming roll shafts 48 and 49 by way of substantially identical couplings 38 and 39. Each such coupling 38 and 39 comprises two mutually connectable halves 42 and 43, the half denoted 42 being designed to rotate as one with the p.t.o. shaft 32, with which it associates either fixedly or in an axially sliding fit.

The two half-couplings 42 and 43 are embodied in such a way as to ensure, when assembled, that the axes of the shafts they interconnect will align automatically one with the other. To this end, the one half-coupling 42 affords a socket 52 having a polygonal cross-section and a flared mouth 62, whilst the remaining half 43 exhibits a spigot having a polygonal cross-section matching that of socket 52, rigidly attached by one end to the relative roll shaft 48, that slides axially into the socket 52 to an exact fit in such a way as to align the p.t.o. shaft 32 with the roll shaft 48 automatically and cause the two shafts to turn as one; in addition, the projecting end of the spigoted half-coupling 43 exhibits a frusto-conical alignment taper 63 that is designed to locate in and interact with the flared mouth 62 of the socket half-coupling 42.

In practice, the exact manner of embodying the two half-couplings 42 and 43 is a matter of choice; at all events, one half must ensure that the connected members will rotate as one, and the two halves must retain the freedom of sliding axially in relation to one another.

With the uppermost journal block 34 free to shift marginally through a vertical plane in relation to the intermediate mounting 45, one obtains a self-aligning match between the two halves 42 and 43 of the relative coupling, and accordingly, it becomes a simple matter to replace the entire stand 1; more exactly, the changeover to another production run is effected with significant despatch by replacing the single stands, or complete sets of stands, with units that will have been assembled and trued-up beforehand remotely from the production line. The operation of replacing the forming rolls in a machine according to the invention is accomplished with ease, simply by releasing the base 2; first, the movable stop 9 is rotated clockwise, whereupon the ram 23 is operated to shift the entire stand 1 in the direction of the arrow 22 through a distance sufficient to separate the couplings 38 and 39 and to ensure that the edge 6 of the base 2 clears the fixed stop 5. In this situation, the stand can be hoisted clear of the table 4 and distanced from the machine bed 3.

The replacement stand 1 can now be lowered down onto the table 4 and the ram 23 operated, causing the projection denoted 25 to engage the base 2 and urge it against the angled surface 7 of the fixed stop 5; this selfsame movement, occurring in the opposite direction to that of the arrow 22, also brings together the two halves 42 and 43 of each coupling 38 and 39.

With the stand 1 drawn into position, the p.t.o. shaft 32 and roll shaft 48 of the topmost roll 12 will be aligned automatically, thanks to the type of fit between the half-couplings 42 and 43 and the ability of the p.t.o. shaft journal block 34 to shift vertically, with respect to its upright 27, in the intermediate mounting 45. Needless to say, before the replacement stand is moved into place, the intermediate mounting 45 will be positioned vertically on the upright 27 in such a way that the distance between the centers of the two p.t.o. shafts 32 and 33 corresponds substantially to that between the shafts 48 and 49 of the replacement rolls. The drive connection will be complete the moment that the prismatic spigot of the replacement half-coupling 43 registers fully in the prismatic socket of the resident half-coupling 42.

The positioning step will be speeded up further by fitting the upright 27 with a measuring device that permits of reading, and therefore of selecting the distance between the upper and lower journal blocks 34 and 35.

In the embodiment illustrated, only the uppermost p.t.o. shaft 32 is able to shift marginally in a vertical direction, whereas the position of the bottom shaft 33 remains fixed in relation to the upright 27, though clearly enough, the option also exists of reversing this situation, and further, of supporting both of the p.t.o. shafts 32 and 33 in intermediate mountings so that both can self-adjust by shifting in the vertical direction.

Finally, it will be appreciated that the operation of replacing the single stand, or a set of stands mounted to a common base 2, is notably fast, as no special requirement exists for fine adjustment of the distance between centers of the p.t.o. shafts in order to guarantee a faultless axial alignment between these and the roll shafts.

What is claimed:

1. A roll forming machine, comprising:

a plurality of stands (1) arranged in succession, each supporting at least two forming rolls (12, 13) disposed with axes parallel and mounted to shafts (48, 49) freely journaled at each end to blocks (14, 15) carried by massive uprights (16, 17) and caused to rotate about their respective axes in opposite directions, the axes extending horizontally with one shaft vertically spaced from the other;

at least one base (2), capable of being clamped to and removed from the bed (3) of the machine, to which the uprights (16, 17) of at least one stand (1) are permanently anchored;

at least one fixed upright (27), located a short distance to one side of the uprights of the stand, that carries two power take-off shafts (32, 33) aligned axially with the roll shafts (48, 49) and freely supported in rotation by relative journal blocks (34, 35) at least one of which is mounted to the upright (27) in such a way as to be allowed a marginal degree of shift transverse to the relative axis of rotation, said relative journal blocks being vertically spaced from one another in said fixed upright;

a geared motor unit (30), by which the power take-off shafts (32, 33) are driven;

two couplings (38, 39), by which the power take-off shafts (32, 33) and the roll shafts (48, 49) are caused to rotate as one, each of which consists in two connectable halves (42, 43), turning as one with the power take-off (32 or 33) and with the roll shaft (48 or 49), respectively, the embodiment of which is such that assembly of the coupling will automatically ensure mutual alignment of the axes of the interconnected shafts, wherein the base (2) to which the uprights (16, 17) of the stand (1) are anchored is clamped to and removed from the machine bed (3) by means of a device that comprises:

a horizontal table (4), on which the base (2) rests, and across which it is traversed, guided in a direction parallel to the axes of the power take-off shafts (32, 33);

a fixed stop (5), affording a locating surface (7) inclined to form an acute angle with the surface of the horizontal table (4) and designed to interact with a complementarily angled surface (6) offered by one side of the base (2), against which the base is clamped to the end of ensuring a faultless and predetermined axial position of the roll shafts (48, 49) in relation to the power take-off shafts (32, 33) when being connected thereto by way of the couplings (38, 39);

a movable stop (9), positioned at the side of the base opposite from the fixed stop (5) and affording a locating surface (11) that is inclined to form an acute angle with the surface of the horizontal table (4) and engages a complementarily angled surface (6) offered by the corresponding side of the base (2), said acute angles and the surface of the table forming openings which face one another and face in the direction of movement of the table has been inserted before.

2. A roll forming machine as in claim 1, wherein the movable stop (9) is of hinged embodiment, pivoted about a horizontal axis lying normal to a vertical plane containing the axes of the power take-off shafts (32, 33) and the roll shafts (48, 49).

3. A roll forming machine as in claim 1, wherein the base (2) is traversed across the horizontal table (4) in a direction parallel with the axes of the power take-off shafts (32, 33) and the roll shafts (48, 49) by a device comprising a ram (23), and a beam (24), reciprocated by the ram along its own axis and incorporating two vertical projections (25, 26) that extend above the level of the table (4) in such a way as to impinge on one or other side of the base (2), according to whether the stand (1) is being clamped or released.

4. A roll forming machine comprising: at least two roll shafts having parallel axes, the axes extending horizontally with one shaft vertically spaced from the other, a plurality of uprights, journal blocks carried by said uprights, said roll shafts being freely journaled at each end to said journal blocks and being caused to rotate in opposite directions about their respective axes, at least two forming rolls supported on each of said uprights and disposed on said shafts, at least one base carrying said uprights and capable of being clamped to and removed from a bed of the machine, at least one fixed upright being permanently anchored to said bed, intermediate mounts attached to said fixed upright, relative journal blocks associated, via resilient means, with said intermediate mounts, to power take-off shafts mounted on said fixed upright via said intermediate mounts, said power take-off shafts aligned axially with said roll shafts one power take-off shaft vertically spaced from the other and being freely supported in rotation by said relative journal blocks, at least one of said power take-off shafts being mounted to and resiliently associated with said fixed upright so as to allow said power take-off shaft a marginal degree of shift transverse to the relative axis of rotation, a geared motor unit driving said power take-off shafts, a socket coupling and a spigot coupling, said couplings being connectable to and axially slidable with respect to each other, said couplings, upon connection with each other, turning as one with the power take-off shaft and with the roll shaft, respectively, said socket coupling having a polygonal cross-section and a coaxially flared mouth, said spigot coupling having a polygonal cross-section matching that of said socket and being rigidly attached at one end to said roll shaft, said spigot coupling slidable axially into and fitting closely with said socket coupling in a manner which ensures axial alignment of said power take-off shaft and said roll shaft, a projecting end of said spigot coupling having a frusto-conical alignment taper designed to locate in and interact with the flared mouth of said socket coupling, wherein said journal block is resiliently mounted so as to normally maintain an intermediate position between an upper position and a lower position, transverse to the axis of shaft rotation, the difference in distance between the upper and lower positions representing the total available journal block movement range.

* * * * *